US006186074B1

(12) United States Patent
Grubba et al.

(10) Patent No.: US 6,186,074 B1
(45) Date of Patent: Feb. 13, 2001

(54) DRIVE ASSEMBLY FOR MODEL TRAIN

(75) Inventors: Robert A. Grubba, Rochester Hills; Caleb Sullivan, Clinton Township; Kevin B. Chlebek, Farmington Hills; Jeffery A. Price, Lakeville, all of MI (US)

(73) Assignee: Lionel Trains, Inc., Chesterfield, MI (US)

( * ) Notice: Under 35 U.S.C. 154(b), the term of this patent shall be extended for 0 days.

(21) Appl. No.: 09/185,304

(22) Filed: Nov. 3, 1998

(51) Int. Cl.[7] ..... B61D 7/18

(52) U.S. Cl. ..... 105/1.5; 105/26.05; 105/29.2; 105/96.1; 105/98; 105/157.2

(58) Field of Search ..... 105/1.5, 26.05, 105/29.2, 34.1, 84, 96.1, 98, 157.2, 176; 74/665 F; 475/150; 180/65.1, 65.5

(56) References Cited

U.S. PATENT DOCUMENTS 3,080,827 * 3/1963 Zion ..... 105/101
4,799,431 * 1/1989 Edwards et al. ..... 105/1.5
5,398,619 * 3/1995 Buccos ..... 105/157.2
5,632,208 * 5/1997 Weber ..... 105/182.1
5,918,546 * 7/1999 Wike ..... 105/168

* cited by examiner

*Primary Examiner*—S. Joseph Morano
*Assistant Examiner*—Frantz Jules
(74) *Attorney, Agent, or Firm*—Young & Basile, P.C.

(57) ABSTRACT

The present invention provides a drive assembly for a model toy train which connects a single drive shaft from an electric motor to a pair of discrete truck assemblies. The drive shaft drives a plurality of pinions which in turn drive a pair of worm shafts which extend toward the truck assemblies. A pair of worm wheel shafts are driven by the worm shafts to drive the wheels on the truck assemblies. A saddle and bearing combination rotationally connects the model toy train to the truck assemblies allowing the truck assemblies to freely rotate.

8 Claims, 3 Drawing Sheets

44
52
62
40
60
64
72
70
72
70
50
102
94
90
96
115
110
104
95
97
91
98
111
116
99
25
20
21
25

DRIVE ASSEMBLY FOR MODEL TRAIN

FIELD OF THE INVENTION

The present invention relates generally to a model train and more particularly to a drive assembly for a model toy train having more than two truck assemblies.

BACKGROUND OF THE INVENTION

Model toy train manufacturers typically make toy models, or replicas of existing or historical trains. Model toy train manufactures make locomotives or engines, box cars, cabooses and many other things. As to the toy train locomotive or engine and its real world counterpart the similarities are little more than in appearance. In terms of external appearance, both real world and toy train engines include truck assemblies having a plurality of wheels positioned on the tracks. Typically each truck assembly rotates about its central axis allowing the train to negotiate turns in the track.

Notwithstanding their visual similarity, real world train engines and toy train engines use very different power sources. Real world train engines are powered by coal fired boilers, gas turbines and diesels while toy train engines are powered by electric motors which receive their power from the train track. A significant difference caused by the different power sources used in real world and model toy train engines is how the power is transferred to the wheels of the truck assemblies to move the train engines forward.

In real world train engines, such as diesel or gas turbine train engines, the diesel or gas turbine generates electricity which is supplied to electric motors. The electric motors are positioned within one or more truck assemblies and drive the wheels positioned on the track. Because the electric motors are positioned within the truck assemblies the truck assemblies may freely turn about their own axes allowing the real world train to negotiate a corner.

In contrast, the electric motors of model toy train engines power the wheels of the truck assemblies through drives shafts. To do this, the drive shafts of the electric motors are positioned directly over the central axis of each truck assembly. In this way the truck assembly can rotate about its axis, and the electric motor remains positioned within the model toy train body.

Positioning the electric motors in model toy train engines on the central axis of the truck assemblies has limited model toy train manufactures to providing toy train engines having no more than two driven truck assemblies. This is because two points define any curve.

Therefore, there is a need to provide a model toy train motor assembly for model toy trains having more than two truck assemblies.

SUMMARY OF THE INVENTION

The present invention provides a drive assembly for a model toy train including at least one motor having a motor shaft fixedly positioned within a model toy train body. At least two truck assemblies are provided each having a plurality of wheels, the truck assemblies positioned below the model toy train body. At least two saddles connect each truck assembly to the model toy train body such that each truck assembly freely rotates about the motor shaft. Means for connecting the motor drive shaft to the wheels of each truck assembly are provided such that when the motor drive shaft rotates it causes the wheels in each truck assembly to rotate.

A method of translating rotational energy from a drive shaft of a electric motor in a model toy train to a plurality of wheels on at least two truck assemblies is also provided. The method includes translating the rotational energy from the electric motor to at least a pair of shafts and translating the rotational energy from each of the pair of shafts to the wheels of the truck assemblies.

A further drive assembly in a model toy train has a toy train body is also provided which includes at least two separate electric engines positioned at discrete positions within the toy train body, each electric engine including a motor shaft. At least two subframes are fixedly attached to the toy train body and at least four truck assemblies, each including a plurality of wheels, are rotationally attached to the subframes such that at least two truck assemblies are attached to each subframe. A plurality of pinions connect each drive shaft to at least four worm shafts such that at least two worm shafts are connected to the pinions in each subframe. At least four worm wheel shafts are provided, each worm wheel shaft discretely connecting one of the worm shafts to one of the at least four truck assemblies with the worm wheel shafts operably connected to the wheels in each of the at least four truck assemblies to rotate the wheels of truck assemblies.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
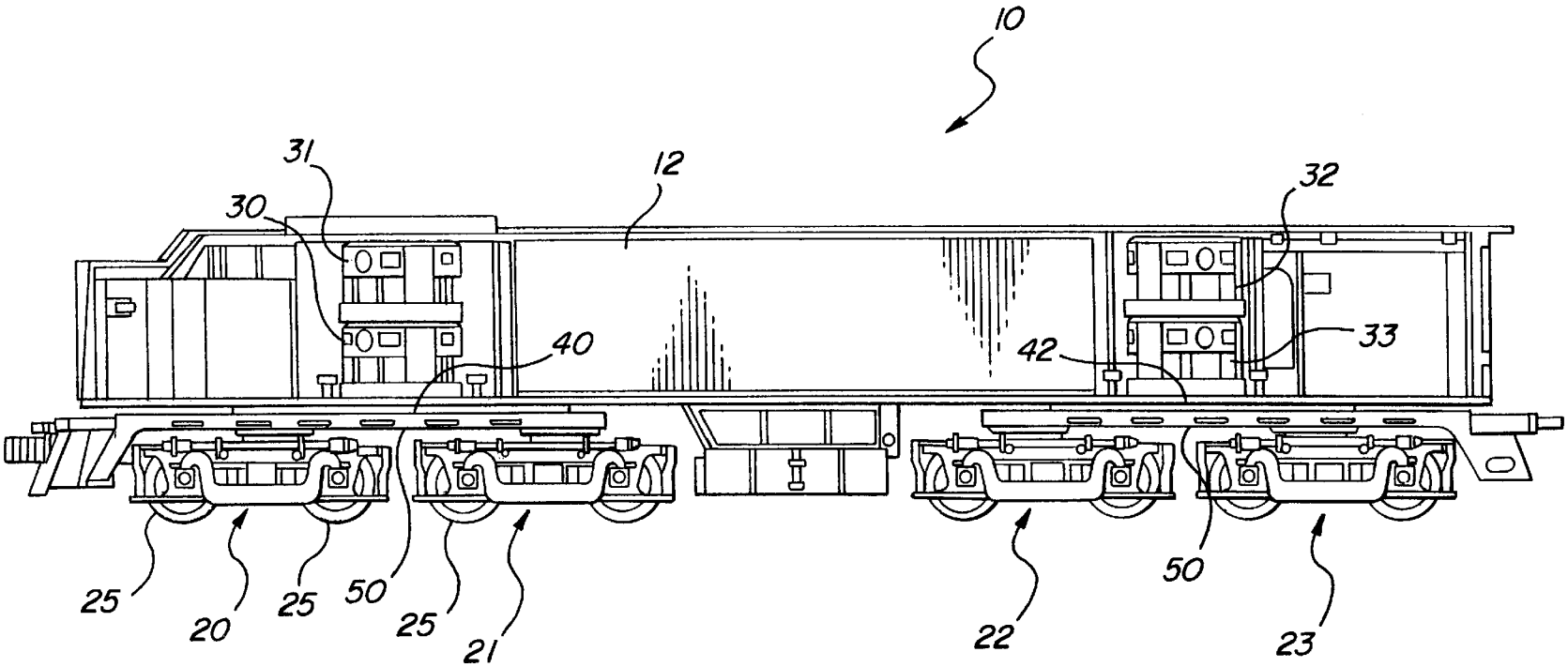
FIG. 1 is a side plan view of a model toy train of the present invention, including a cut away.
Figure 2:
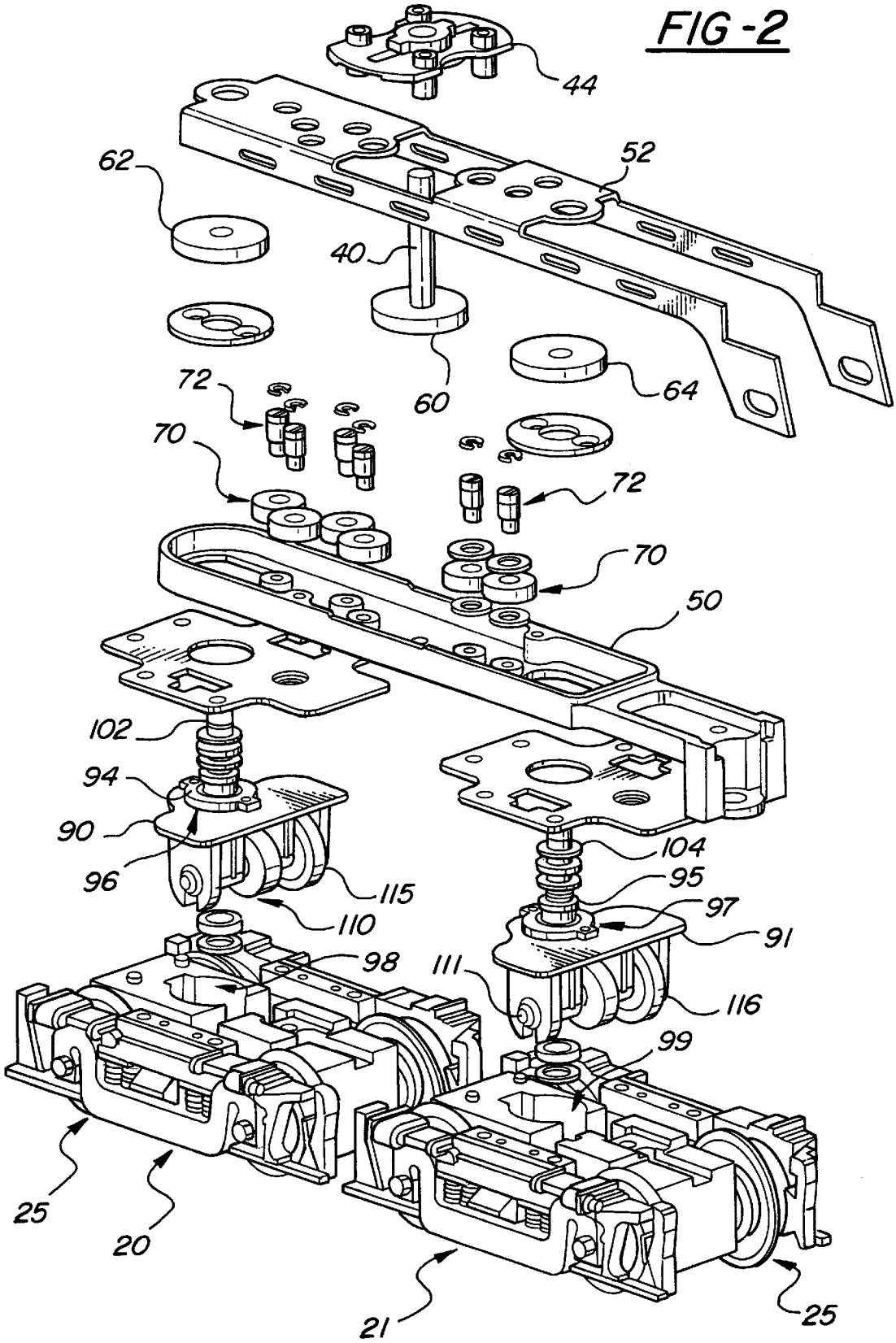
FIG. 2 is an exploded perspective view of the first preferred drive assembly of the present invention.
Figure 3:
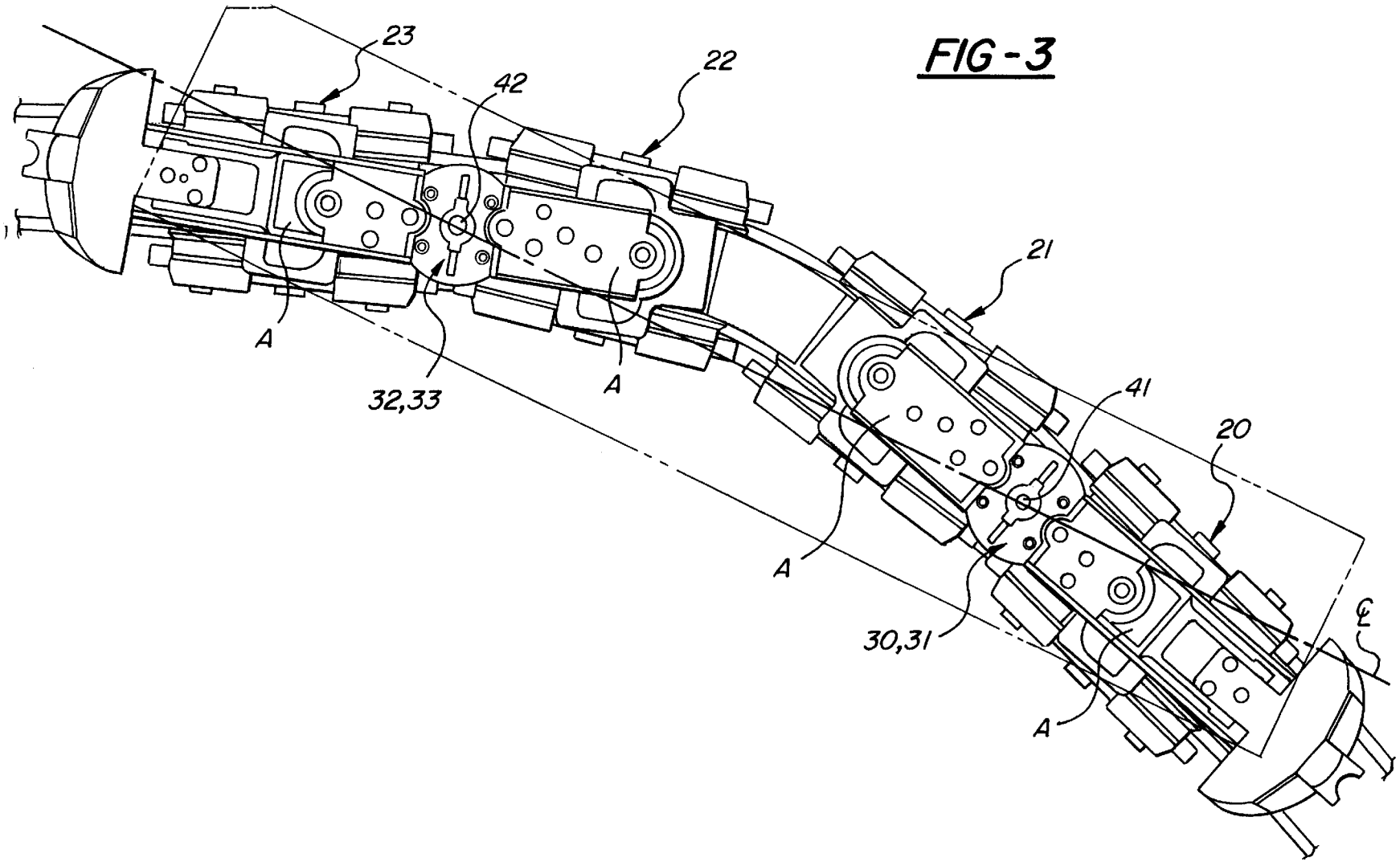
FIG. 3 is a top view of a model toy train of the present invention traveling around a curve in a train track.

With reference to FIGS. 1–3, wherein like elements are numbered like FIG. 1 generally illustrates a model train 10 including an outer train body 12. As shown, outer body 12 is mounted to four truck assemblies, 20, 21, 22, and 23 respectively. Each truck assembly includes a plurality of wheels 25 which are adapted to ride on a track (not shown). For purposes of the present invention, the truck assemblies may be of any known configuration including but not limited to those disclosed and described in U.S. Pat. No. 5,398,619 which is incorporated herein by reference.

As further illustrated in FIG. 1, there is shown four electric motors 30, 31, 32 and 33. In the preferred embodiment the electric motor is a Lionel Odyssey brand brushless electric motor, however it is appreciated that other electric motors may be utilized. Further, while four electric motors, positioned in 2×2 tandem, are illustrated, it is understood that in alternate embodiments two electric motors could be provided rather than four, or six motors could be provided 3×2 in tandem. In the preferred embodiment four electric motors are provided to give the electric model toy train engine additional power. Each pair of motors drives a single motor drive shaft 40 and 42 respectively. Each motor shaft defines a motor mount axis.

As illustrated in FIG. 1 the model toy train includes a subframe 50. Subframe 50 includes a cover 52 and is fixedly connected to model toy train 10. FIG. 2 illustrates an exploded view of the first preferred embodiment of the drive assembly of present invention where motor drive shaft 40 drives truck assemblies 20 and 21. The drive assembly is preferably housed in subframe 50. However, it is understood that the drive assembly of the present invention may be positioned within the train body rather than the subframe.

As shown drive shaft 40 passes through a motor mount assembly 44 fixed between train body 12 and subframe 50. Motor shaft 40 is driven by electric motors 30 and 31 and includes a drive or spur gear 60 mounted on the distal end thereof. As shown, drive gear 60 engages pinion gears 70 mounted in subframe 50 as to transfer the rotational energy to drive gears 62 and 64 also positioned in subframe 50. As shown, pinion gears 70 are mounted on pinion shafts 72 within subframe 50. Drive gears 62 and 64 are fixedly mounted to worm shafts 102 and 104 respectively which project downwardly from subframe 50. Thus, as motor shaft 40 and drive gear 60 rotates, pinions 70 and drive gears 62 and 64 cause worm shafts 102 and 104 to rotate.

Subframe 50 is mounted to truck assemblies 20 and 21 through a pair of saddles 90 and 91 and bearing flanges 94 and 95 such that truck assemblies 20 and 21 may rotate independently of subframe 50. Bearing flange 94 and 95 are mounted within a bores 96 and 97 respectively and rotate therein. Saddles 90 and 91 engage truck assemblies 20 and 21 in a lose nesting arrangement within cavities 98 and 99. Connecting subframe 50 to trucks 20 and 21 as above described and illustrated allows trucks to move with three degrees of freedom. In this fashion the trucks can pitch and yaw as model toy train 10 negotiates banked corners, or travels up and down hills. Also, because the saddle has a little play in it relative to each truck assembly the train can easily switch tracks, as is commonly done.

Worm shafts 102 and 104 pass through bearing flanges 94 and 95 respectively and engage a worm wheel shafts 110 and 111 respectively. Each worm wheel shaft 110 and 111 is positioned perpendicularly to worm shafts 102 and 104 respectively. As worm shafts 102 and 104 rotate, they in turn cause worm wheel shafts 110 and 111 to rotate. Worm wheel shafts 110 and 111 are each connected to wheels 25 of each truck through drive gears 115 and 116, thus translating energy to wheels 25 of each truck assembly 20 and 21 to move the model train engine assembly along the track. It is understood that alternate shafts may be provided to the above described worm shafts. For example additional drive shafts having gears at their proximal and distal ends could function to translate rotational energy to the wheels on the truck assemblies.

The above described construction allows the subframe to rotate about each motor mount axis and the motor and subframe to rotate about the motor mount axis. Thus as illustrated in FIG. 3 the model toy train can navigate a curve in a train track with motor mount axes remaining centered within the train body and each truck free to independently rotate to maintain contact with the track. As can be seen by the point indicated by letter A, if each electric motor where mounted directly above the center point of each truck assembly, they would not be along the center line of the model toy train body, thus limiting the amount any given truck assembly could rotate and limiting the manner in which it can turn.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A model toy train including a model toy train body comprising:

at least one motor having a motor shaft, the motor being fixedly positioned within a model toy train body;

at least two truck assemblies having a plurality of wheels positioned below the model toy train body;

at least two saddles connecting each truck assembly to the model toy train body such that each truck assembly freely rotates and;

means for connecting the motor shaft to the wheels of the truck assemblies such that when the motor drive shaft rotates it causes the wheels in each truck assembly to rotate.

2. A model toy train as in claim 1 wherein the means for connecting comprises:

at least two worm shafts;

a plurality of pinion gears and pinion shafts operably connected to the motor drive gear and operably connected to the worm shafts;

at least two worm wheel shafts operably connected to the worm shafts and operably connected to the wheels of the truck assemblies such that the drive shaft causes the pinions to rotate, the pinions cause each worm shaft to rotate, each worm shaft causes the worm wheel shaft to rotate and each worm wheel shaft causes the wheels on the truck assemblies to rotate.

3. A model toy train as in claim 2 wherein each saddle is further provided with a bearing flange rotatably connecting each truck assembly to the model toy train body.

4. A model toy train as in claim 2 further comprising a subframe positioned between the truck assemblies and the model toy train body, the subframe fixedly connected to the model toy train body, and the truck assemblies rotatably connected to the truck assemblies through the saddles and bearing flanges.

5. A model toy train as in claim 4 wherein the pinion gears and pinion shafts are positioned within the subframe.

6. A model toy train as in claim 5 wherein the motor includes a pair of electric motors stacked in tandem and driving a single drive shaft.

7. A method of translating rotational energy from a drive shaft of an electric motor in a model toy train to a plurality of wheels on at least two truck assemblies comprising:

translating the rotational energy from the electric motor to at least a pair of shafts;

translating the rotational energy from each of the pair of shafts to the wheels of the truck assemblies wherein the rotational energy is translated to a plurality of pinons which in turn translate rotational energy to at least two worm shafts.

8. A drive assembly in a model toy train having a toy train body comprising:

at least two separate electric engines positioned at discrete positions within the toy train body, each electric engine including a drive shaft;

a least two subframes fixedly attached to the toy train body;

at least four truck assemblies, each including a plurality of wheels, rotationally attached to the subframes such that at least two truck assemblies are attached to each subframe;

a plurality of pinions connected to each drive shaft, the pinions positioned in each subframe;

at least four worm shafts connected to the pinions, such that at least two worm gears are connected to the pinions in each subframe;

at least four worm wheel shafts, each worm wheel shaft discretely connecting one of the worm shafts to one of the at least four truck assemblies with the worm wheel shafts operably connected to the wheels in each of the at least four truck assemblies to rotate the wheels of truck assemblies.

* * * * *